US005504310A

United States Patent [19]

Bae

[11] Patent Number: 5,504,310

[45] Date of Patent: Apr. 2, 1996

[54] MICROWAVE OVEN WITH HEATER COVER

[75] Inventor: Yeong J. Bae, Changwon, Rep. of Korea

[73] Assignee: Goldstar Co., Ltd., Seoul, Rep. of Korea

[21] Appl. No.: 352,069

[22] Filed: Nov. 30, 1994

[30] Foreign Application Priority Data

Dec. 4, 1993 [KR] Rep. of Korea ..... 1993-26460

[51] Int. Cl.[6] ..... H05B 6/78

[52] U.S. Cl. ..... 219/685; 219/757; 219/404; 219/754

[58] Field of Search ..... 219/685, 681, 219/754, 757, 756, 402, 403, 404, 405

[56] References Cited

U.S. PATENT DOCUMENTS

| | | | |
|---|---|---|---|
| 3,081,392 | 3/1963 | Warner | 219/685 |
| 3,878,350 | 4/1975 | Takagi | 219/685 |
| 4,096,369 | 6/1978 | Tanaka et al. | 219/685 |
| 4,326,113 | 4/1982 | Toyoda et al. | 219/754 |
| 4,357,513 | 11/1982 | Kawata et al. | 219/685 |
| 4,804,812 | 2/1989 | Tanaka et al. . | |
| 4,908,488 | 3/1990 | Park | 219/685 |
| 5,082,999 | 1/1992 | Yamaguchi et al. . | |
| 5,147,993 | 9/1992 | Braun et al. | 219/685 |
| 5,177,333 | 1/1993 | Ogasawara . | |
| 5,189,274 | 2/1993 | Yamaguchi et al. . | |

FOREIGN PATENT DOCUMENTS

| | | | |
|---|---|---|---|
| 53-148740 | 12/1978 | Japan | 219/685 |

*Primary Examiner*—Philip H. Leung

[57] ABSTRACT

A microwave oven having a heater and a wall structure, includes a heater cover disposed between the heater and the wall structure and a plurality of protruding portions formed on the heater cover and on a depressed portion of the wall structure, respectively. The heater cover includes a bent portion formed at its peripheral edge, and a hanger, for hanging the heater, is fixed to the heater cover to prevent the heat transfer in every direction from the heater. In addition, the protruding portions are brought into contact with each other and are fixed by rivets. The microwave oven further includes an air conduit for guiding an air flow produced by a fan to a space between the wall structure and the heater cover.

4 Claims, 5 Drawing Sheets

MICROWAVE OVEN WITH HEATER COVER

BACKGROUND OF THE INVENTION

The present invention relates to a microwave oven with a heater, and more particularly to a microwave oven with a heater cover to protect a cooking chamber made of heat sensitive materials such as a steel plate treated with a powder coating from being deteriorated by heat.

Generally, there are two types of microwave ovens. A first type cooks food by a high frequency wave oscillated from a magnetron and second type conduct the browning of the food by a heater in addition to the conventional type of microwave oven.

As shown in FIG. 1, a conventional microwave oven includes a cooking chamber 2 provided in a housing 4, a motor 1 generating a rotation force, a turntable 3 rotating food F by the motor 1, a magnetron 5 heating the food F on the turntable 3, and a wall structure 7 made of a galvanized steel plate treated with powder coating. In addition, as shown in FIG. 2, a second type microwave oven with a heater further includes a grilling rack 10 put on the turntable 3, a heater 9 generating heat to grill the food F on the grilling rack 10, and a heater hanger 12 fixing the heater 9. Furthermore, the wall structure 7 in the second type microwave oven is made of stainless steel.

In the first type microwave oven, though the high frequency wave oscillated by the magnetron 5 moves water molecules in the food F and consequently heats the food F, the surface color of the cooked food F does not change, so that an appetite is not stimulated. Accordingly, in order to solve the above-mentioned problem, there is provided the second type microwave oven for browning the food F by the heater 9 in the cooking chamber 2.

However, if a wall structure 7 made of a galvanized steel plate treated with powder coating is used in the second type microwave oven, the color of the coating surface changes and the coating surface melts by the heat of the heater 9, so that the expensive wall structure made of stainless steel is preferably used. In this case, in order to prevent damage such as scratches on the outer surface, a metal mold operation is performed with a protective vinyl wrapper covering and the protection vinyl wrapper covering should be removed again after the operation, so that productivity is much decreased. In addition, a stainless steel plate itself is much more expensive than a general galvanized steel plate and the manufacture of the metal mold for a stainless steel is also difficult in terms of technique and production cost.

SUMMARY OF THE INVENTION

It is an object of the present invention to provide a microwave oven including a heater cover disposed between a wall structure and a heater and means for fixing the heater cover to the wall structure, thereby preventing a discoloration or a melting of the coating surface of the wall structure caused by the heater.

The heater cover includes a bent portion formed at a peripheral edge and means for fixing one end of the heater when the other end of the heater is fixed to the wall structure in order to prevent the heat transfer in every direction from the heater. It is preferable that the heater cover is made of enamel materials. The means for fixing the heater cover includes a plurality of protruding portions formed on the heater cover and on a depressed portion of the wall structure respectively, thereby keeping the distance between the heater cover and the wall structure consistent. In addition, the protruding portions are brought into contact with each other and are fixed by rivets.

In the foregoing, a microwave oven with a heater cover further includes means for guiding an air flow produced by a fan to a space between the wall structure and the heater cover, thereby preventing a temperature rise of the upper surface of the heater cover.

DETAILED DESCRIPTION OF THE INVENTION

Figure 1:
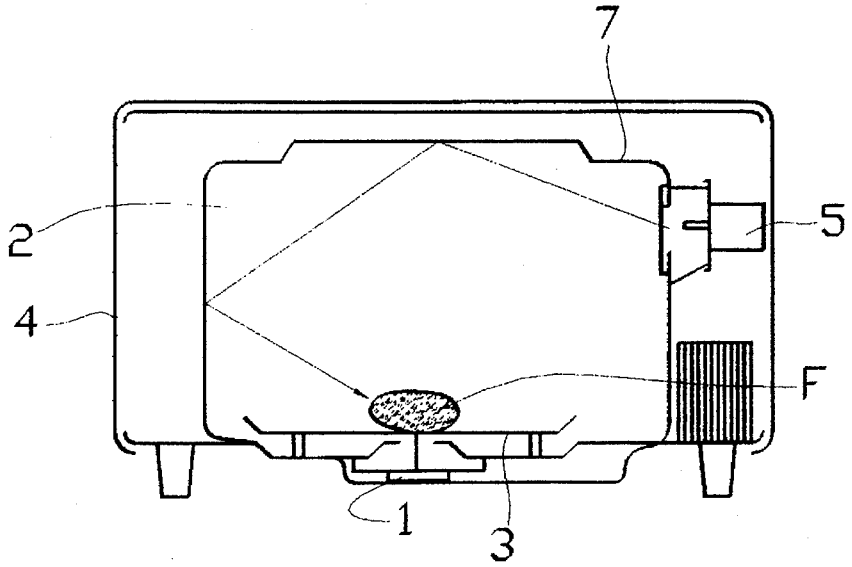
FIG. 1 PRIOR ART
FIG. 1 is a side sectional view of a conventional microwave oven.
Figure 2:
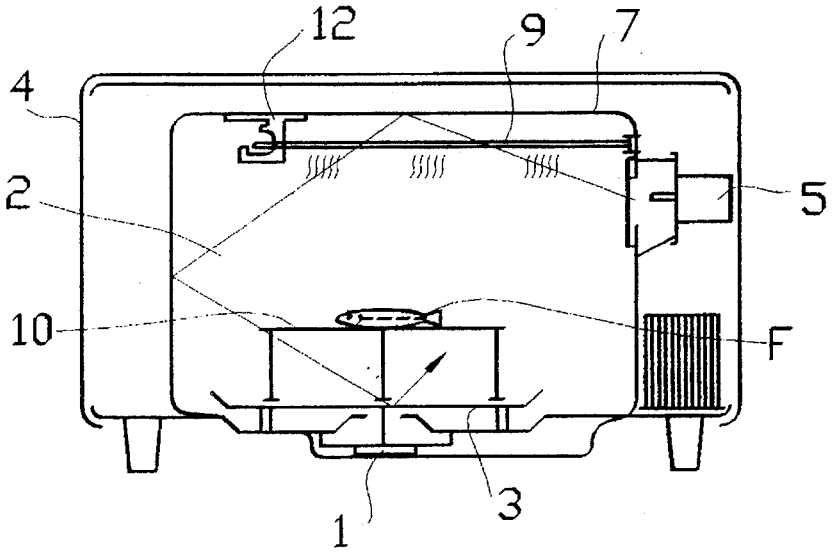
FIG. 2 PRIOR ART
FIG. 2 is a side sectional view of a conventional microwave oven with a heater.
Figure 3:
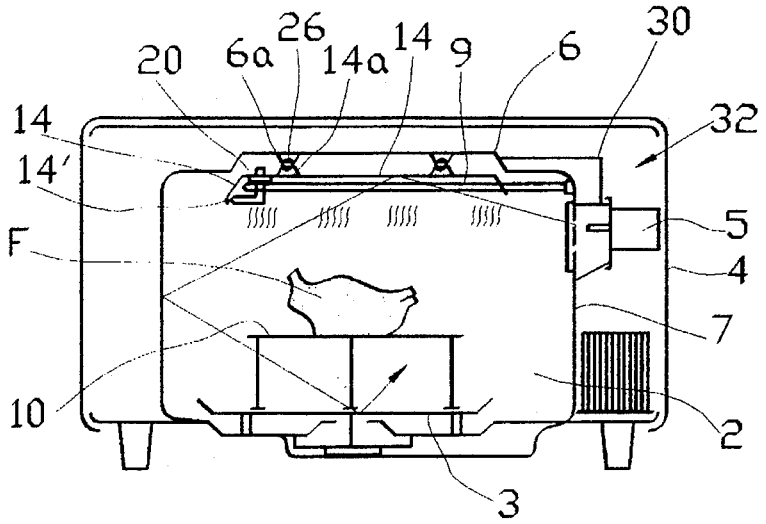
FIG. 3 is a side sectional view of a microwave oven with a heater cover according to the present invention.
Figure 4A:
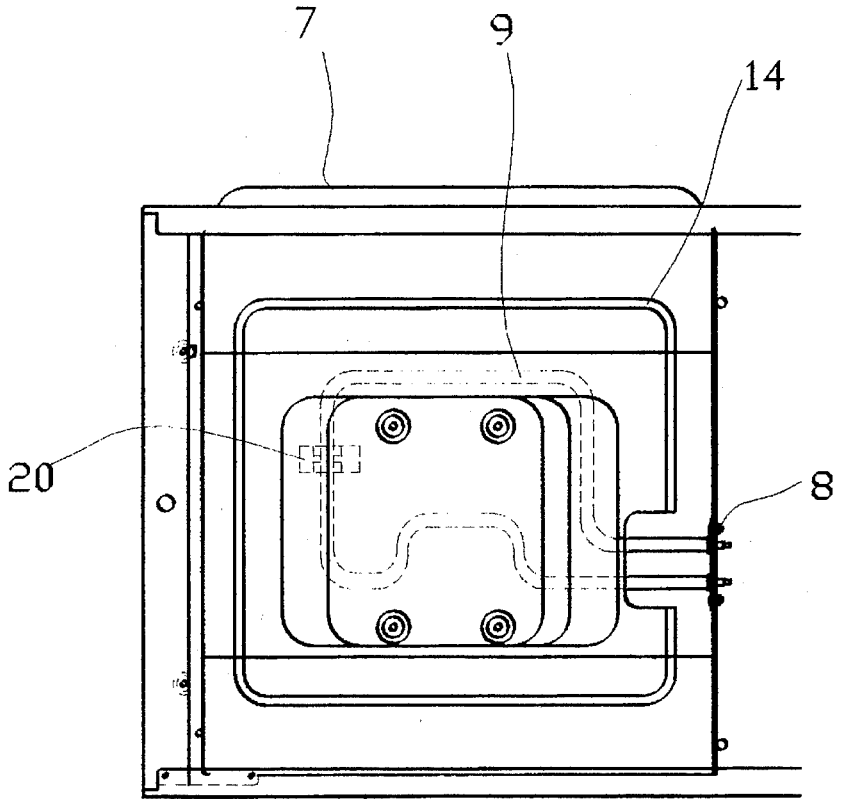
FIG. 4A and 4B are enlarged fragmentary plan and front views of a microwave oven according to the present invention, particularly showing a heater cover.
Figure 4B:
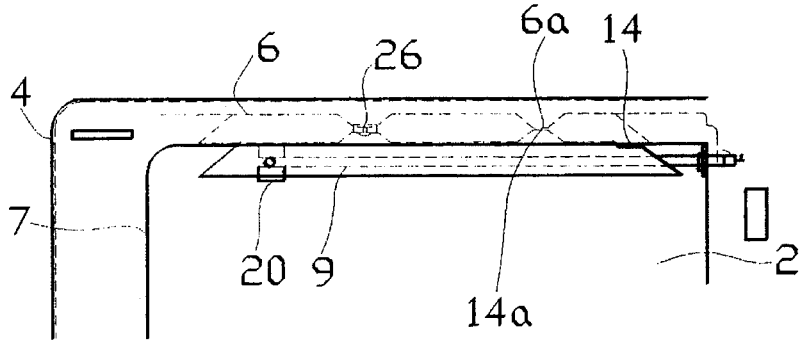

Preferred embodiments of the present invention are described in detail hereinafter with reference to FIGS. 3 to 5.

A microwave oven according to the present invention comprises a cooking chamber 2 provided in a housing 4, a magnetron 5 generating a high frequency wave to heat food F on a turntable 3, and a wall structure 7 to which one end of a heater 9 for browning the food F is attached, a heater cover 14 disposed between the wall structure 7 and the heater 9, and means for fixing the heater cover 14 to the wall structure 7.

The heater cover 14 includes a bent portion 14' formed at its peripheral edge and means for fixing one end of the heater 9 when the other end of the heater 9 is fixed to the wall structure 7 by a nut (FIG. **4*a*). The bent portion prevents the heat transfer in every direction from the heater 9. The heater cover 14 is preferably made of enamel materials. The means for fixing the heater 9 comprises a hanger 20 having a groove 20*c* (FIG. 5) for hanging the heater 9 and a neck 20*n*, an insertion aperture 23 formed in the heater cover 14, to receive the neck 20*n*, and a slit 23' formed on one side of the aperture 23, to hold the neck 20*n* inserted into the aperture 23 by moving the neck 20*n* in R direction, and to prevent the release of the hanger 20**.

The means for fixing the heater cover 14 includes protruding portions **6*a* and 14*a* formed on the heater cover 14 and on a depressed portion 6 of the wall structure 7 respectively, and keeps the distance between the heater cover 14 and the wall structure 7 consistent. In addition, the protruding portion 6*a* of the depressed portion 6 of the wall structure 7 and the protruding portion 14*a* of the heater cover 14 are brought into contact with each other and are fixed by inserting a rivet 26 into holes 6*h* and 14*h* formed at the protruding portions 6*a* and 14*a***.

The microwave oven with a heater cover according to the present invention further comprises an air conduit 30 having an air passageway 30' for guiding an air flow blown from a fan 32 to a space between the wall structure 7 and the heater cover 14, thereby preventing a temperature rise of the upper surface of the heater cover 14.

Figure 6:
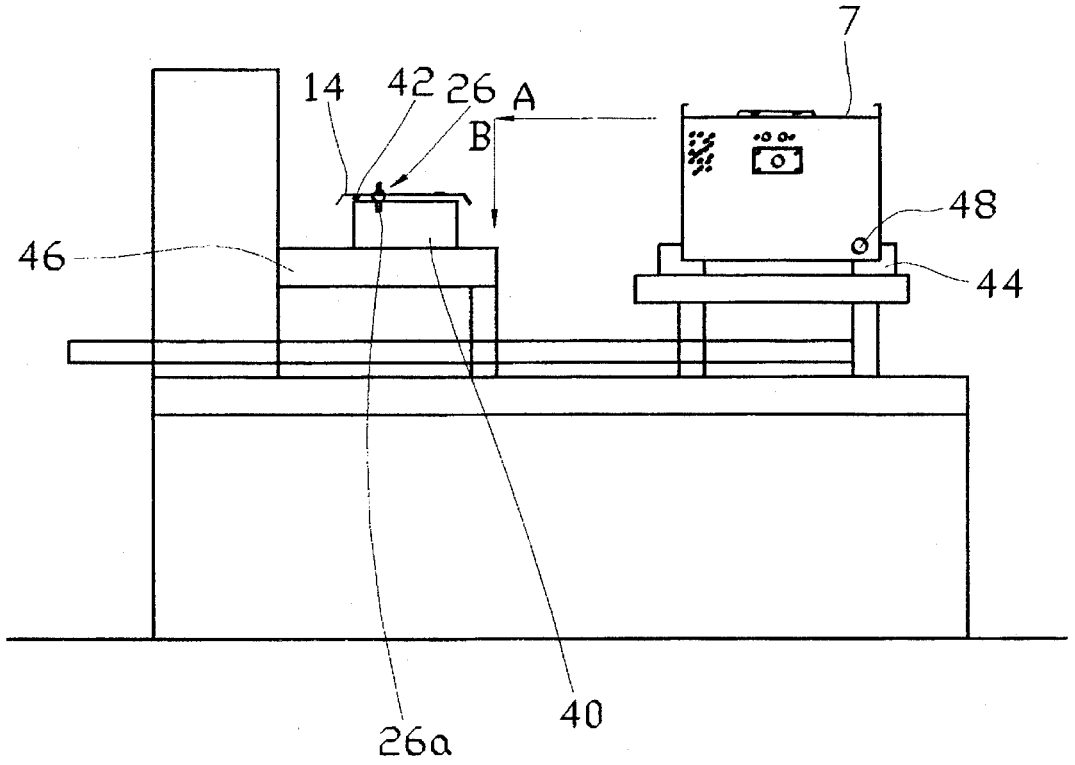
FIG. 6 shows an operation of a riveting machine for assembling a microwave oven according to the present invention.
Figure 7:
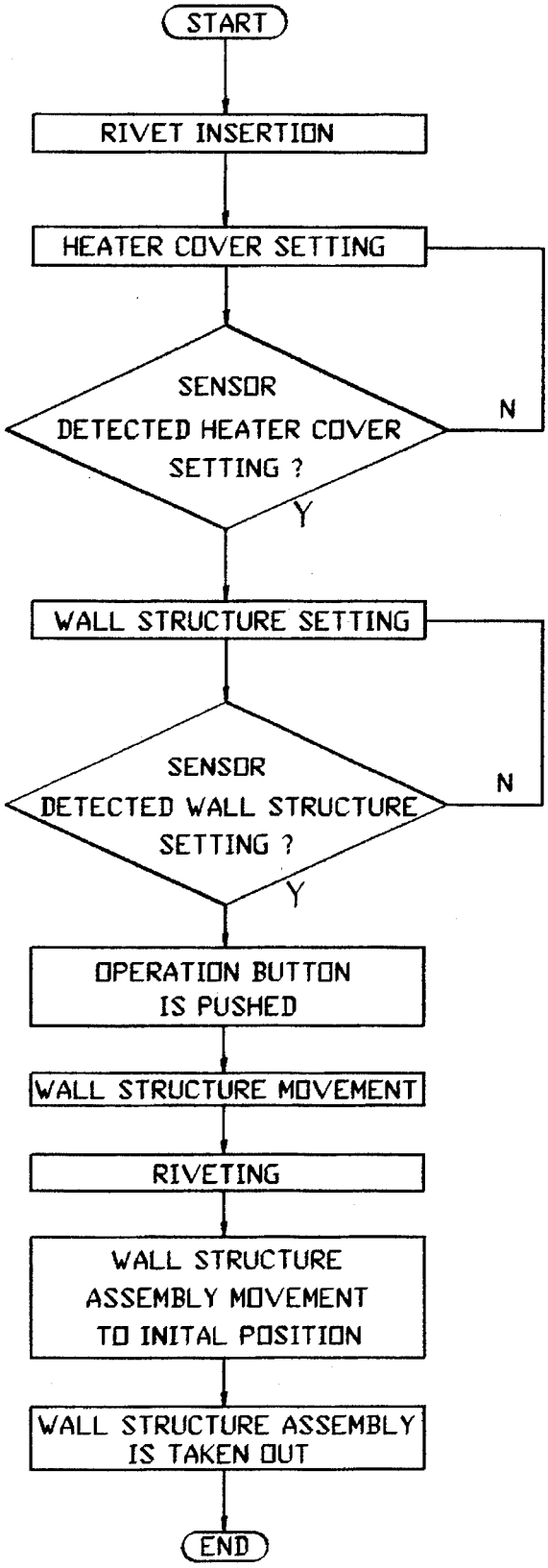
FIG. 7 is a flow chart explaining the operation of the riveting machine of FIG. 6.

As shown in FIGS. 6 and 7, a riveting machine carries out a riveting by using the rivet 26 for fixing the heater cover 14, and consequently keeps the distance between the heater cover 14 and the depressed portion 6 of the wall structure 7 consistent. The riveting machine comprises (a) a rivet holder 40 into which a lower portion 26*a* of the blind rivet 26 is inserted, (b) a heater cover detection sensor 42, which is provided on the rivet holder 40, for detecting whether the holes 14*h* of the heater cover 14 are positioned according to the guidance of the head portion of the rivet 26, (c) a positioning guide 44 for moving as soon as an operation button (not shown) is pushed, and then positioning the hole 6*h* of the wall structure 7 to the head portion of the rivet 26, when the heater cover detection sensor 42 senses the heater cover 14 and a wall structure detection sensor 48 provided therein also senses the wall structure 7, and (d) a descending table 46 for pulling the lower portion 26*a* of the blind rivet 26 and consequently completing the riveting at several places simultaneously if the positioning guide 44 puts the wall structure 7 upon the heater cover 14.

Figure 5:
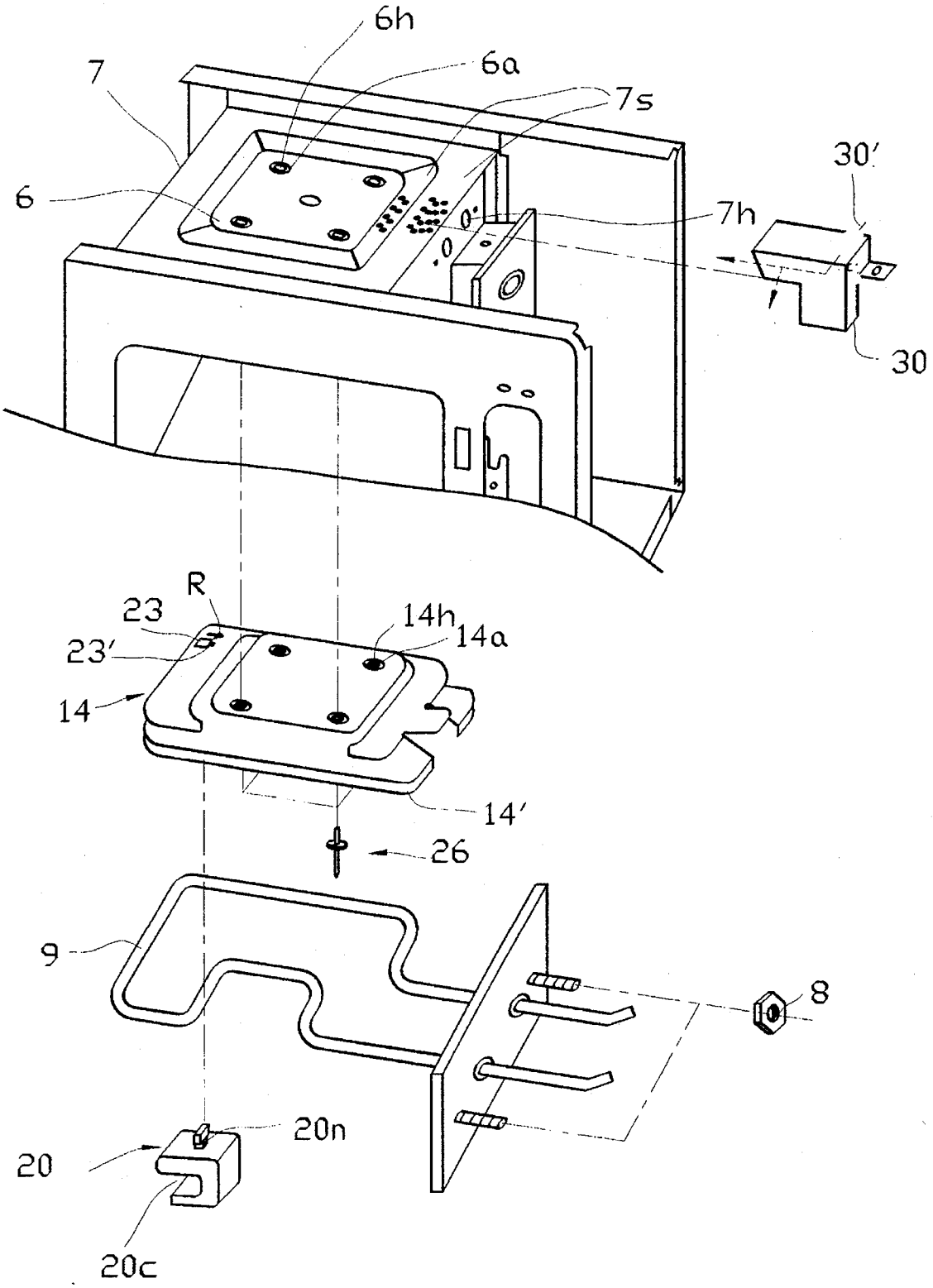
FIG. 5 is an exploded perspective view of a microwave oven with a heater cover according to the present invention.

As shown in FIG. 5, in order to fix the heater cover 14 to the wall structure 7 by rivets 26, several small protruding portions 6*a* are formed on the depressed portion 6 of the wall structure 7 in a direction as opposed to the depressed direction, and several holes 6*h* for inserting the rivets 26 are further formed at the distal end of the protruding portions 6*a*. In addition, several small protruding portions 14*a* are formed on the heater cover 14 and several holes 14*h* for inserting the rivet 26 are formed in the same manner. The protruding portions 14*a* and holes 14*h* of the heater cover 14 are brought into contact with the protruding portions 6*a* and holes 6*h* of the wall structure 7, respectively.

After the riveting for bringing the heater cover 14 into contact with the wall structure 7 is completed, the heater 9 is inserted into a hole 7*h* formed on the right side of the wall structure 7 and simultaneously is hung to the groove 20*c* of the hanger 20. Then, the neck 20*n* of the hanger 20 is inserted into the aperture 23 of the heater cover 14, and both the heater 9 and the hanger 20 are moved in the R direction at the same time. As a result, the neck 20*n* of the hanger 20 is fitted into the slit 23' of the aperture 23 and then one end of the heater 9 is fixed to the wall structure 7 by the nut 8.

Also, a plurality of small holes 7*s* are formed on the right side of the upper surface of the wall structure 7 at which the air conduit 30 is provided so as to guide the air flow blown from the fan 32 to the space between the wall structure 7 and the heater cover 14 by altering the air passageway 30'.

The blind riveting process of the riveting machine is described in detail hereinafter with reference to FIGS. 6 and 7.

First, the lower portion 26*a* of the rivet 26 is inserted into the rivet holder 40 of the riveting machine and then the hole 14*h* of the heat cover 14 is positioned by means of the head portion of the rivet 26. At this time, if the heater cover detection sensor 42 senses that the heater cover 14 is not set, the succeeding steps do not proceed further for fool proof operation. After the heater cover 14 is set on the rivet holder 40, the wall structure 7 to be assembled with the heater cover 14 is set on the positioning guide 44. In this case, if the wall structure detection sensor 48 senses that the wall structure 7 is not set, the succeeding steps are not performed.

After the heater cover 14 and the wall structure 7 are set as described above, the positioning guide 44 is moved in the A and B directions sequentially by pushing the operation button. If the positioning guide 44 puts the wall structure 7 upon the heater cover 14, the descending table 46 pulls the lower portion 26*a* of the rivet 26 and completes the riveting at several places simultaneously. After the riveting, the wall structure assembly is moved to the initial position in the reverse order of the above-mentioned steps and is taken out, so that the blind riveting process of the riveting machine ends.

As described above, the present invention prevents the heat transfer in every direction from the heater by means of the bent portion of the heater cover. The heat conduction to the upper wall of the cooking chamber is further reduced because the protruding portions formed on the heater cover and the wall structure have a small contact area. In addition, the air conduit precludes a temperature rise of the upper surface of the heater cover by guiding an air flow blown from the fan to the space between the heater cover and the wall structure. Therefore, the heater for browning food can be mounted within the cooking chamber made of heat sensitive materials.

Also, the riveting at several places, performed simultaneously by the riveting machine, results in a tighter riveting than if the riveting were performed in sequence. As a result, strength, airtightness, and productivity are improved.

While specific embodiments of the invention have been illustrated and described wherein, it is to be realized that modifications and changes will occur to those skilled in the art. It is therefore to be understood that the appended claims are intended to cover all modifications and changes as they fall within the true spirit and scope of the invention.

What is claimed is:

1. A microwave oven, having a housing, a cooking chamber defined in said housing, a magnetron generating microwaves, a turntable disposed within said cooking chamber, a motor rotating said turntable, and a heater fixed to a wall structure of said cooking chamber, said microwave oven further comprising:

a heater cover, disposed between said wall structure and said heater including a bent portion formed at a peripheral edge, means for fixing one end of said heater when the other end of said heater is fixed to said wall structure; and means for fixing said heater cover to said wall structure; wherein said means for fixing said heater comprises:

a hanger having a neck and a groove for hanging said heater;

an insertion aperture formed in said heater cover to receive said neck; and a slit formed on one side of said insertion aperture to hold said neck inserted into said aperture.

2. A microwave oven, having a housing, a cooking chamber defined in said housing, a magnetron generating microwaves, a turntable disposed within said cooking chamber, a motor rotating said turntable, and a heater fixed to a wall structure of said cooking chamber, said microwave oven further comprising:

a heater cover, disposed between said wall structure and said heater, and means for fixing said heater cover to said wall structure; wherein said means for fixing said heater cover includes a plurality of protruding portions formed on said heater cover and on a depressed portion of said wall structure, respectively, said protruding portions being brought into contact with each other and being fixed by rivets.

3. A microwave oven according to claim 2, further comprising means for guiding an air flow produced by a fan to a space between said wall structure and said heater cover.

4. A microwave oven according to claim 2, wherein said means for fixing said heater further includes:

a hanger having a neck and a groove for hanging said heater;

an insertion aperture formed in said heater cover to receive said neck; and a slit formed on one side of said insertion aperture to hold said neck inserted into said aperture.

* * * * *